US005281105A

United States Patent [19]

Osaka et al.

[11] Patent Number: 5,281,105

[45] Date of Patent: Jan. 25, 1994

[54] HERMETIC COMPRESSOR

[75] Inventors: Masahiko Osaka, Chigasaki; Hideki Kawai, Fujisawa; Yuji Saiki, Yokohama; Satoshi Wada, Fujisawa, all of Japan

[73] Assignee: Matsushita Refrigeration Company, Osaka, Japan

[21] Appl. No.: 40,097

[22] Filed: Mar. 30, 1993

[30] Foreign Application Priority Data

Apr. 6, 1992 [JP] Japan ..... 4-083566

[51] Int. Cl.[5] ..... F04B 21/00

[52] U.S. Cl. ..... 417/312; 181/403

[58] Field of Search ..... 417/312, 902; 181/403, 181/200, 202, 198; 62/296, 469, 508

[56] References Cited

U.S. PATENT DOCUMENTS

| | | | |
|---|---|---|---|
| 2,928,589 | 3/1960 | Davey | 417/902 |
| 3,187,995 | 6/1965 | Eldsen | 62/296 |
| 4,345,882 | 8/1982 | Saito et al. | 417/902 |
| 4,384,635 | 5/1983 | Lowery | 181/403 |
| 4,729,723 | 3/1988 | Outzen | 417/312 |

FOREIGN PATENT DOCUMENTS 3-53476 8/1991 Japan .

*Primary Examiner*—Richard A. Bertsch
*Assistant Examiner*—Peter Korytnyk
*Attorney, Agent, or Firm*—Polloack, VandeSande & Priddy

[57] ABSTRACT

A hermetic compressor comprising a compressing mechanism and a housing for encasing the compressing mechanism, the housing comprising upper and lower portions which are coupled to each other and being formed to have curved surfaces. The housing is constructed such that one curved line on the housing is arranged to be different from other curved lines existing at positions symmetrical with a position of the one curved line with respect to planes X, Y and Z perpendicular to one another and passing the housing, the plane X including a boundary portion between the upper and lower portions of the housing and being perpendicular to a center line passing through a center of an upper surface of the upper portion and a center of a bottom surface of the lower portion, and the planes Y and Z being perpendicular to each other and perpendicular to the plane X and including the center line.

2 Claims, 3 Drawing Sheets

HERMETIC COMPRESSOR

BACKGROUND OF THE INVENTION

The present invention relates to a hermetic compressor applicable to refrigeration systems such as a cold storage, and more particularly to an arrangement of a closing housing of a hermetic compressor.

One of major problems arising in the use of a hermetic compressor is generation of noises. One known noise reduction technique is disclosed in the Japanese Patent Publication No. 3-53476. A brief description will be made hereinbelow with reference to FIGS. 5 and 6 in terms of a conventional hermetic compressor based on such a noise reduction technique. FIG. 5 is a side view showing an entire arrangement of the conventional hermetic compressor and FIG. 6 is a top view of the conventional hermetic compressor. In FIGS. 5 and 6, the hermetic compressor is composed of a compressing unit including a compressing section 6 and a drive section 5 which are encased in a closing housing (vessel) 1 comprising an upper portion (cover) 2 and a lower portion 3 coupled through a coupling edge (welded edge) 4 to each other. Between the compressing section 6, or the drive section 5, and the closing housing 1 there are provided elastic members (not shown) through which vibrations generated by the compressing section 6 and the drive section 5 are transferred to the closing housing 1 and others. However, in such a conventional hermetic compressor, two symmetrical curves are formed with respect to one of planes passing through the hermetic compressor and perpendicular to each other. These curves have the same center and are equal in curvature to each other. This can lower the resonance frequency of the closing housing 1, thereby enhancing the noises and vibrations of the hermetic compressor.

SUMMARY OF THE INVENTION

It is therefore an object of the present invention to provide a closing housing of a hermetic compressor which is capable of heightening the resonance frequency to reduce the noises and vibrations.

According to this invention, in a hermetic compressor comprising a compressing mechanism and a housing having curved surfaces for encasing the compressing mechanism which is constructed with upper and lower portions which are coupled to each other, the housing is constructed such that one curved line on the housing is arranged to be different in curvature, length and others from other curved lines existing at positions symmetrical with a position of the one curved line with respect to planes X, Y and Z perpendicular to one another and passing the housing. The plane X includes a boundary portion between the upper and lower portions of the housing and is perpendicular to a center line passing through a center of an upper surface of the upper portion and a center of a bottom surface of the lower portion, and the planes Y and Z are perpendicular to each other and perpendicular to the plane X and includes the center line.

In addition, the housing is arranged such that an inner product of unit normal vectors of a point A1*x* on the housing and in the plane X and a point A2*x* existing in a normal direction of the point A1*x* is $|1|$, and, when a plane perpendicular to the plane X and including the points A1*x* and A2*x* is taken as Y' and a plane perpendicular to the planes X and Y' and including the center line is taken as Z', an inner product of unit normal vectors of points A1*y* and A2*y* on the housing and in a crossover line of said planes Y' and Z' is $|1|$, and further, an inner product of unit normal vectors of points A1*z* and A2*z* on the housing and in a crossover line of the planes X and Z' is $|1|$.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
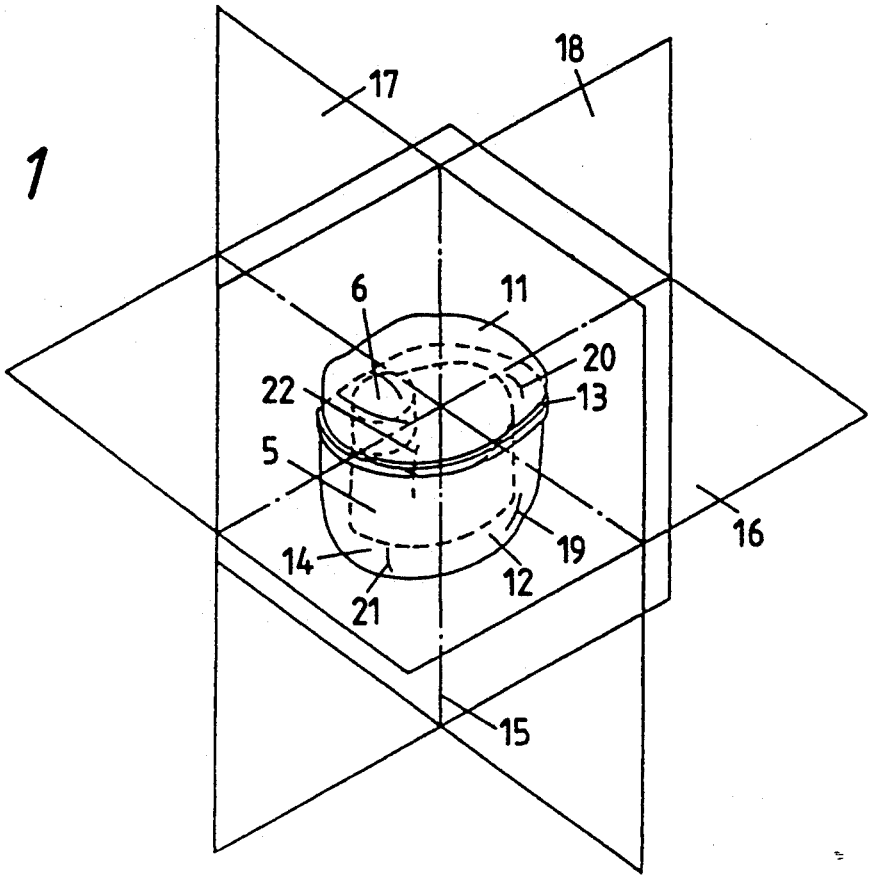
FIG. 1 is a perspective view for describing a closing housing of a hermetic compressor according to a first embodiment of the present invention.

Referring now to FIG. 1, a description will be made hereinbelow in terms of a first embodiment of the present invention. In FIG. 1, closing housing 14 of a hermetic compressor including a compressing section 6 and a drive section 5 comprises an upper portion 11 and a lower portion 12 which are coupled through a coupling edge (formed at the opening of the upper or lower portion 11, 12) 13 to each other. The upper portion 11 has a first curved surface which acts as a top surface of the closing housing 14 and the lower portion 12 has a second curved surface which acts as a bottom surface of the closing housing 14. Designated at numeral 15 is a center line passing through the centers of the first and second curved surfaces of the upper and lower portions 11 and 12 of the closing housing 14. Here, we consider three plans (X, Y, Z planes) 16, 17 and 18 perpendicular to one another. The X plane 16 passes through the coupling edge 13 and is perpendicular to the center line 15, and the Y and Z planes 17 and 18 respectively include the center line 15 and are perpendicular to each other. At this time, on the surface of the closing housing 14, one position takes symmetrical relation to three positions with respect to the X to Z planes 16 to 18. In this embodiment, all curved surfaces of the closing housing 14 are arranged so as not to be in symmetrical relation to one another with respect to the X to Z planes 16 to 18. That is, when considering a given curved line (C) 19 on the surface of the closing housing 14, three curved lines (Cx20, Cy21, Cz22) 20, 21 and 22 respectively appear at the positions symmetrical with the position of the given curved line 19 with respect to the X to Z planes 16 to 18, while these four curved lines 19 to 22 are arranged so as to be different in curvature from one another and different in length from one another. This arrangement can increase the resonance frequency of the closing housing 14, thereby reducing the noises and vibrations of the hermetic compressor.

Figure 2:
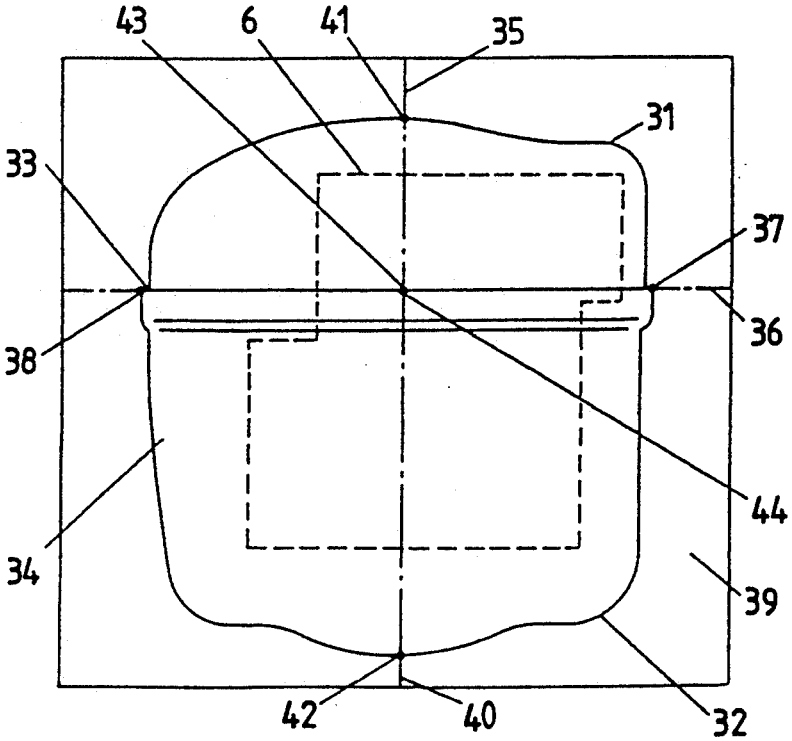
FIGS. 2 to 4 are illustrations for describing a closing housing of a hermetic compressor according to a second embodiment of this invention.
Figure 3:
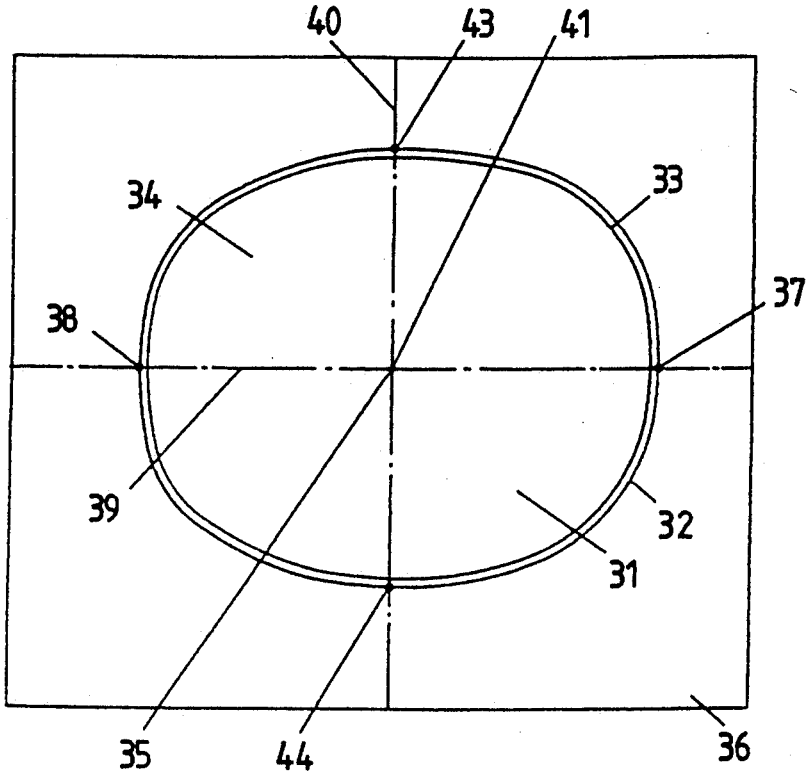
Figure 4:
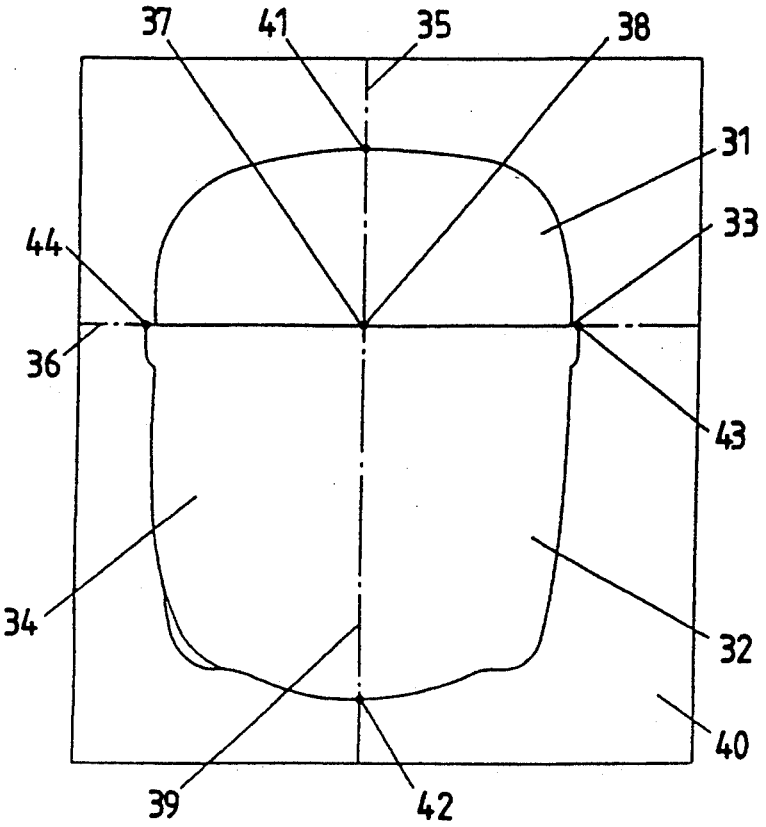
Figure 5:
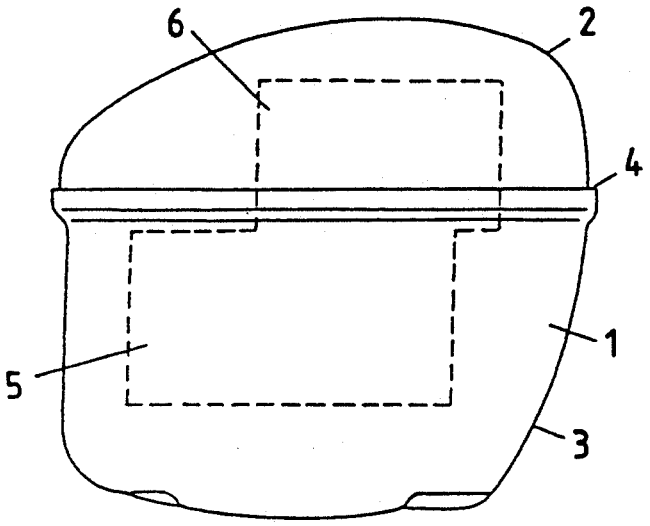
FIG. 5 PRIOR ART
FIGS. 5 and 6 are illustrations for describing a conventional hermetic compressor.
Figure 6:
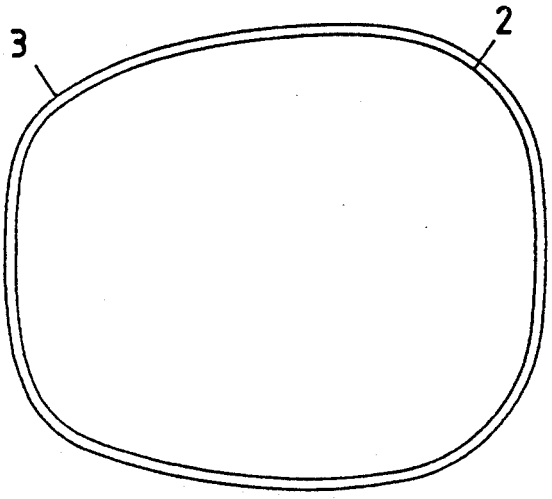
FIG. 6 PRIOR ART

Further, a description will be made hereinbelow with reference to FIGS. 2 to 4 in terms of a second embodiment of this invention. FIG. 2 is a side view showing a hermetic compressor according to the second embodiment of this invention, FIG. 3 is a top view showing the same hermetic compressor, and FIG. 4 is a front view showing the same hermetic compressor. In FIGS. 2 to 4, a closing housing 34 is constructed with an upper portion 31 and a lower portion 32 which are coupled through a coupling edge 33 to each other. Designated at numeral 35 is a center line passing through the center of the upper surface of the upper portion 31 and the center of the bottom surface of the lower portion 32. Numeral 36 represents an X plane including the coupling edge 33, and numerals 37 and 38 are points (A1*x*, A2*x*) on the X plane 36. The point 38 exists in the normal line direction of the point 37. In this embodiment, the inner product of the unit normal vectors of the points 37 and 38 is arranged to be |1|. Further, numeral 39 denotes a Y' plane perpendicular to the X plane 36 and includes the aforementioned points 37 and 38, and numeral 40 depicts a Z' plane perpendicular to the X plane 36 and the Y' plane 39 and including the center line 35. Numerals 41 and 42 are points (A1*y*, A2*y*) existing on the closing housing 34 and existing the crossover line of the Y' plane 39 and the Z' plane 40. The inner product of the unit normal vectors of these points 41 and 42 is arranged to be |1|. Moreover, numeral 43 and 44 are points (A1z, A2*z*) existing on the closing housing 34 and existing on the crossover line of the X plane 36 and the Z' plane 40. Similarly, the inner product of the unit normal vectors of these points 43 and 44 is arranged to be |1|.

This arrangement can prevent one curved line on the closing housing 34 from becoming equal to other curved lines at positions symmetrical with the position of the one curved line with respect to the X, Y' and Z' planes 36, 39 and 40, thereby offering the same effect as the above-described first embodiment.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A hermetic compressor comprising:

a compressing mechanism for compressing an object; and a housing for encasing said compressing mechanism, said housing comprising upper and lower portions which are coupled to each other, said housing being formed to have curved surfaces and constructed such that one curved line on said housing is arranged to be different from other curved lines existing at positions symmetrical with a position of said one curved line with respect to planes X, Y and Z, said plane X including a boundary portion between said upper and lower portions of said housing and being perpendicular to a center line passing through a center of an upper surface of said upper portion and a center of a bottom surface of said lower portion, and said planes Y and Z being perpendicular to each other and perpendicular to said plane X and including said center line.

2. A hermetic compressor as claimed in claim 1, wherein said housing is arranged such that an inner product of unit normal vectors of a point A1*x* on said housing and in said plane X and a point A2*x* existing in a normal direction of said point A1*x* is |1|, and, when a plane perpendicular to said plane X and including said points A1*x* and A2*x* is taken as Y' and a plane perpendicular to said planes X and Y' and including said center line is taken as Z', an inner product of unit normal vectors of points A1*y* and A2*y* on said housing and in a crossover line of said planes Y' and Z' is |1|, and further, an inner product of unit normal vectors of points A1*z* and A2*z* on said housing and in a crossover line of said planes X and Z' is |1|.

* * * * *